US005269463A

United States Patent [19]

Burks

[11] Patent Number: 5,269,463

[45] Date of Patent: Dec. 14, 1993

[54] FLUIDIZED POWDER FEED SYSTEM WITH PRESSURIZED HOPPER

[75] Inventor: Leonard R. Burks, Big Spring, Tex.

[73] Assignee: Plastic Flamecoat Systems, Inc., League City, Tex.

[21] Appl. No.: 888,057

[22] Filed: May 22, 1992

Related U.S. Application Data

[63] Continuation-in-part of Ser. No. 760,866, Sep. 16, 1991.

[51] Int. Cl.[5] ..... B65G 53/12

[52] U.S. Cl. ..... 239/85; 239/654; 239/79; 406/44; 406/138; 406/146

[58] Field of Search ..... 239/85, 79, 654; 406/137, 138, 146, 127, 192, 44, 39

[56] References Cited

U.S. PATENT DOCUMENTS

| | | | |
|---|---|---|---|
| 2,924,489 | 2/1960 | Beckmann | 406/146 |
| 3,129,889 | 4/1964 | Cape . | |
| 3,134,513 | 5/1964 | Ashman et al. | 406/138 |
| 3,179,378 | 4/1965 | Zenz et al. | 406/138 |
| 3,208,799 | 9/1965 | Rivers | 406/138 |
| 3,333,774 | 8/1967 | DeMaison . | |
| 3,442,454 | 5/1969 | Stenger et al. . | |
| 3,993,359 | 11/1976 | Sweeney | 406/137 |
| 4,203,689 | 5/1980 | Kraxner et al. | 406/138 |
| 4,231,518 | 11/1980 | Zverev et al. . | |
| 4,290,555 | 4/1981 | Suwa et al. . | |
| 4,615,649 | 10/1986 | Sharpless | 406/138 |
| 4,632,309 | 12/1986 | Reimer . | |
| 4,647,003 | 3/1987 | Hilpert et al. . | |
| 4,678,120 | 7/1987 | Matsuo | 239/85 |
| 4,835,022 | 5/1989 | Huhne | 239/85 |
| 4,901,921 | 2/1990 | Dallaire et al. | 239/85 |
| 4,934,595 | 6/1990 | Reimer . | |
| 5,071,289 | 12/1991 | Spivak . | |
| 5,148,986 | 9/1992 | Rusch | 239/85 |

FOREIGN PATENT DOCUMENTS

| | | |
|---|---|---|
| 304719 | 2/1917 | Fed. Rep. of Germany . |
| 3640906 | 6/1988 | Fed. Rep. of Germany . |
| 812601 | 4/1959 | United Kingdom . |
| 1140511 | 1/1969 | United Kingdom . |

*Primary Examiner*—Andres Kashnikow
*Assistant Examiner*—Christopher G. Trainor
*Attorney, Agent, or Firm*—Ross, Howison, Clapp & Korn

[57] ABSTRACT

A feed system for flame spray guns is provided that comprises a hopper with a powder storage chamber, a pressurized gas source separated from the powder storage chamber by a gas distributor board, at least one flow line providing fluid communication for the pressurized air and entrained powder between the storage chamber and a flame spray gun, a powder outlet valve on each flow line for controlling the flow of pressurized gas and entrained powder from the storage chamber into the flow line, and a purge line delivering pressurized gas to the flow line downstream of the powder outlet valve for clearing powder from the flow line after the valve is closed.

1 Claim, 3 Drawing Sheets

FLUIDIZED POWDER FEED SYSTEM WITH PRESSURIZED HOPPER

CROSS REFERENCE TO RELATED APPLICATIONS

This application is a continuation in part of application Ser. No. 07/760,866, filed Sep. 16, 1991, still pending, which is incorporated by reference herein.

BACKGROUND OF THE INVENTION

1. Field of the Invention

This invention relates to apparatus for use in supplying a particulate material comprising a powdered thermoplastic resin to a flame spray gun.

2. Description of Related Art

Methods and apparatus for flame spraying thermoplastic resins onto substrates are previously known, having been disclosed for example in U.S. Pat. Nos. 4,632,309 and 4,934,595.

Application Ser. No. 07/760,866, filed Sep. 16, 1991 and assigned to the assignee of this application, discloses a feed assembly for use in a flame spray coating system comprising a powder source, a pressurized gas source, a pressure regulator for regulating a stream of gas from the pressurized gas source, an eductor for introducing powder into the stream of gas from the pressurized gas source, and means for selectively controlling the introduction of powder into the stream of gas from the pressurized gas source. In one preferred embodiment disclosed in application Ser. No. 07/760,866, the powder source comprises a gravity fed powder hopper communicating with the eductor assembly. The powder source and feed assembly disclosed therein is adapted to be attached to a backpack worn by the operator, or else mounted on a portable stand.

Powder hoppers for use with flame spray coating systems have also been disclosed that are adapted for use with multiple hoses and flame spray guns. Such systems are advantageous for some applications because several operators can work simultaneously using a single, larger volume powder source that can be situated away from the operators. One such application is in flame spraying a thermoplastic coating on the inside of large storage tanks. A stationary hopper containing a relatively large volume of powder can be situated outside the tank, and a plurality of hoses connected to the hopper can supply powder to flame spray guns used by different operators.

Notwithstanding the advantages of the flame spray coating systems previously known, difficulties have been encountered with powder feed systems that utilize a hopper in which a bulk quantity of powder comprising a thermoplastic resin is gravity fed to an eductor assembly that entrains the powder in a gas stream for delivery through a flow line to a flame spray gun. Bridging or clumping of the powder within the hopper can disrupt flow to the flame spray gun even when an adequate supply of powder remains in the hopper, causing inefficiency and unnecessary downtime.

SUMMARY OF THE INVENTION

According to the present invention, a feed system for flame spray guns is provided that comprises a fluidized hopper.

According to one embodiment of the invention, a system is provided that comprises a hopper with a powder storage chamber, a pressurized gas source separated from the powder storage chamber by a gas distributor board, at least one flow line providing fluid communication for the pressurized air and entrained powder between the storage chamber and a flame spray gun, a powder outlet valve on each flow line for controlling the flow of pressurized gas and entrained powder from the storage chamber into the flow line, and a purge line delivering pressurized gas to the flow line downstream of the powder outlet for clearing powder from the flow line valve after the valve is closed.

According to another embodiment of the invention, a feed system for flame spray guns is provided that comprises a hopper with a powder storage chamber, a plenum, a gas distributor disposed between the powder storage chamber and the plenum, and means for loading powder into the storage chamber; inlet means for receiving a flow of pressurized gas from an external source and for directing the pressurized gas into the plenum; the gas distributor comprising means for distributing the flow of pressurized gas to fluidize powder within the powder storage chamber and entrain the powder in the pressurized gas; outlet means for receiving pressurized gas and entrained powder from the storage chamber and for delivering the pressurized gas and entrained powder through a flow line to a flame spray gun; and valve means having open and closed positions for controlling the flow of pressurized gas and entrained powder through the outlet means. According to a preferred embodiment of the invention, the subject feed system further comprises purge means for delivering pressurized gas to the flow line downstream of the powder outlet to clear powder from the flow line valve after the valve means is closed.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
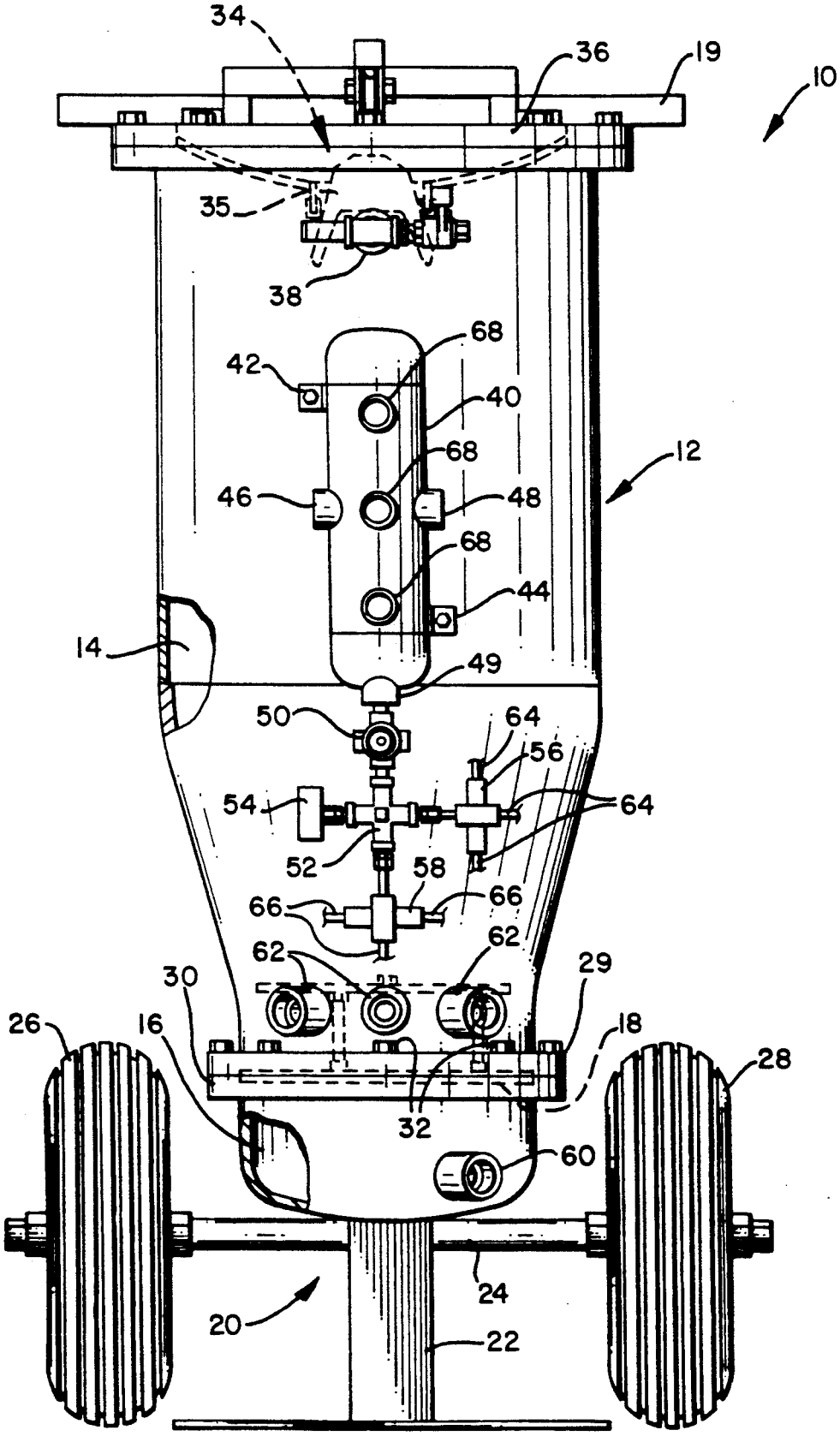
FIG. 1 is a simplified front elevation view of the hopper system of the invention.
Figure 2:
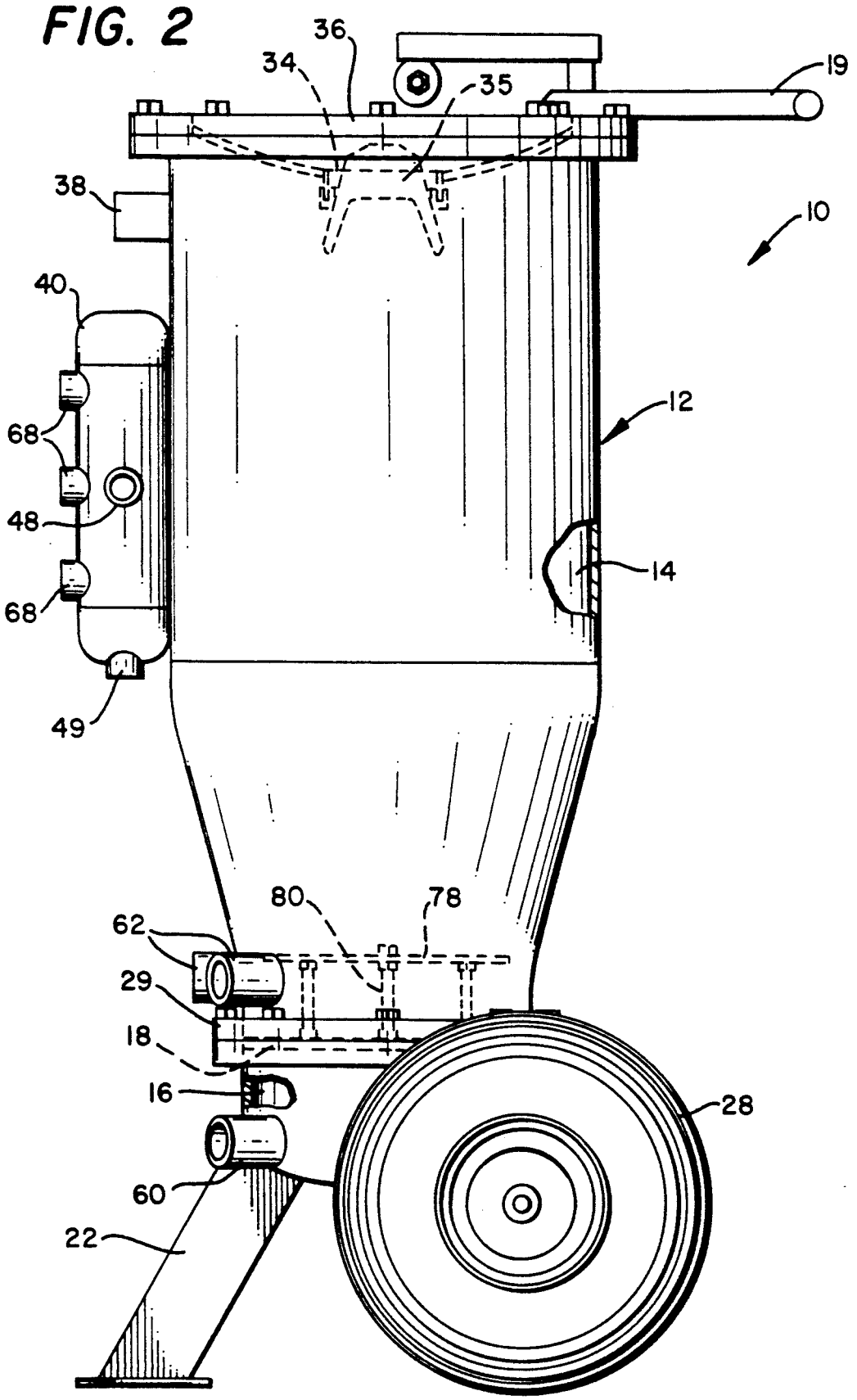
FIG. 2 is a simplified side elevation view of the hopper system of FIG. 1.
Figure 3:
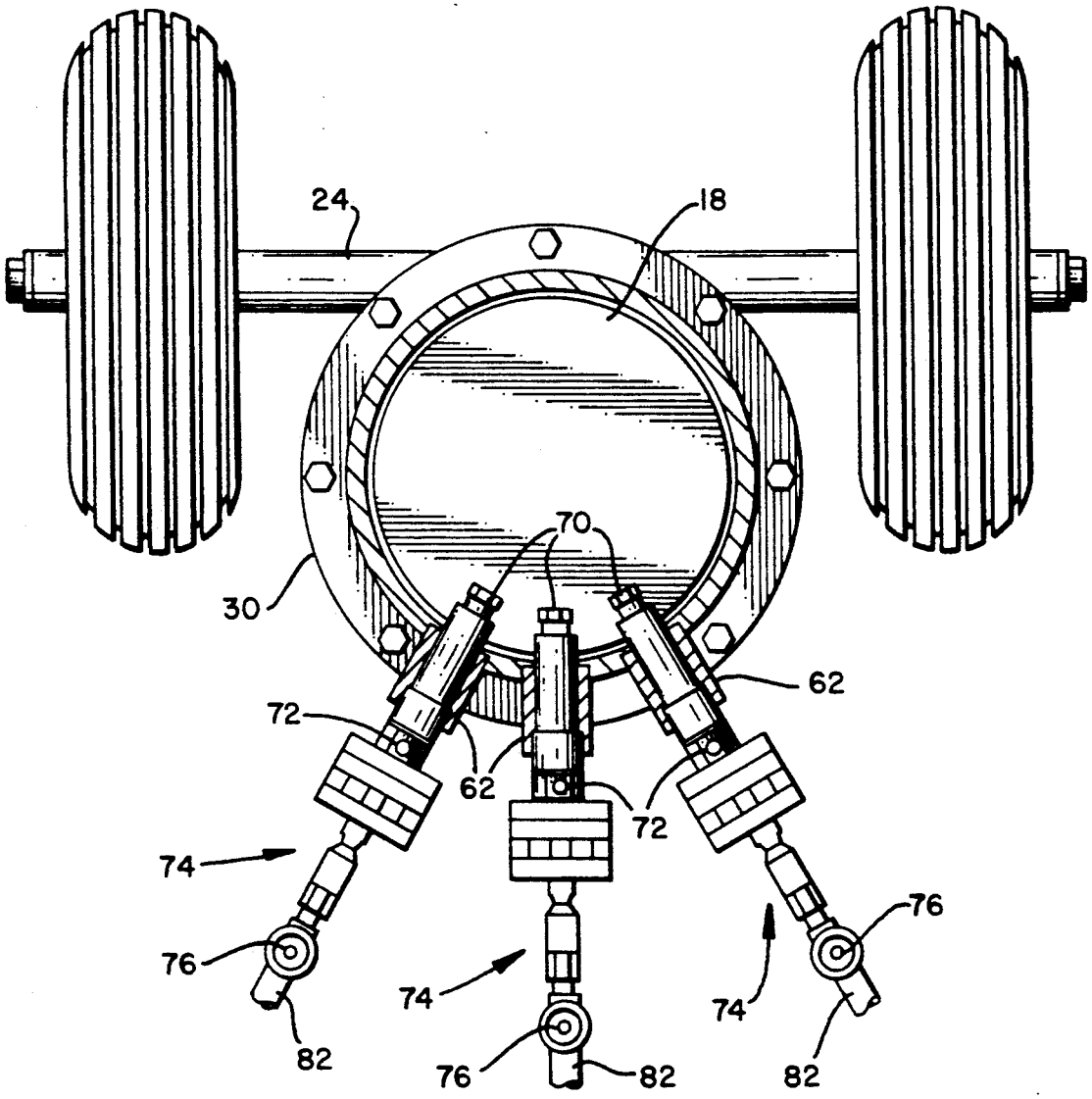
FIG. 3 is a simplified plan view taken through hopper 12 at outlets 62 above flange 30, with the associated fittings and valving of outlets 62 being shown in somewhat greater detail than in FIGS. 1 and 2.

Referring to a preferred embodiment of the invention as depicted in simplified form in FIGS. 1 through 3, hopper feed system 10 of the invention preferably comprises hopper 12 supported by carriage 20. Handle 19, stand 22, axle 24 and wheels 26, 28 are preferably provided to facilitate movement of hopper 12 as desired. Hopper 12 preferably further comprises powder storage chamber 14, which utilizes most of the interior volume of hopper 12, and plenum 16, disposed below powder storage chamber 14 in the embodiment shown. Gas distributor 18, preferably a conventional, commercially available "air board", is disposed between chamber 14 and plenum 16, and is preferably held in place between flanges 29, 30, which are secured to each other by bolts 32.

Powder loading port 34 is preferably provided in the top of chamber 14 for use in loading the powder, preferably comprising a major portion of a thermoplastic resin, into hopper 12. Plug 35 and cover 36 are adapted to seal powder loading port 34 when hopper 12 is loaded and pressurized, as discussed in more detail below. Port 38 in hopper 12 is provided for connection to a pressure relief valve (not shown) to prevent hopper 12 from becoming overpressured during use.

Air supply tank 40 is preferably mounted on the outside of hopper 12 by means of brackets 42, 44. As depicted in simplified form in FIGS. 1 and 2, air supply tank 40 is provided with a single inlet port 46 adapted to be connected by conventional means to a source (not shown) of pressurized gas, preferably air. Although not shown in the drawings, it will be understood that conventional auxiliary devices including, for example, pressure regulators, pressure gauges and moisture traps, can be installed between the pressurized gas source and inlet port 46.

A plurality of outlet ports 48, 49, 68 from air supply tank 40 are also shown in FIGS. 1 and 2, with some of the conventional, commercially available auxiliary couplings, regulators, gauges and the like that would be desirable but well understood to those of ordinary skill in the art again being omitted from the drawings for ease of illustration. In the embodiment shown, outlet ports 68 are provided for attachment by hoses to a plurality (in this case three) of flame spray guns. This enables more than one operator to perform flame spray coating operations at the same time from a single feed system. Pressurized "propelling air", as that term is disclosed and used in U.S. Pat. No. 4,934,595, is preferably delivered to each respective flame spray gun through a different one of outlet ports 68. Outlet port 48 is preferably adapted to supply pressurized air (through conventional lines, regulators, gauges, etc. not shown) to inlet port 60 communicating with plenum 16 of hopper 12.

During operation of hopper feed system 10, after powdered plastic resin is loaded into chamber 14, and cover 36 is closed, the powdered plastic is fluidized by injecting pressurized gas, preferably air, into plenum 16 through inlet port 60. Gas distributor 18 is preferably adapted to permit the upward passage of the pressurized gas into chamber 14, but to block the downward flow of powder into plenum 16. When the powdered plastic is fluidized in this manner, it can be more easily entrained in the pressurized gas, which is then withdrawn from chamber 14 through outlet ports 62 and delivered through hoses, not shown, to flame spray guns that can be located many feet (or meters) away. By fluidizing the powder within chamber 14, problems previously associated with bridging, clumping and plugging of the powder are successfully avoided. According to a particularly preferred embodiment of the invention, plate 78 (best seen in FIG. 2), having a diameter slightly less than that of gas distributor 18 to permit circulation of gas and powder around it, is provided to support the powder above outlets 62 whenever pressurized gas is not being injected into hopper 12 through inlet 60.

Referring to FIGS. 1 and 3, each outlet port 62 is preferably provided with an outlet nozzle 70, which communicates through valve 74 with a hose 82 adapted to deliver powdered plastic entrained in pressurized gas to each respective flame spray gun being fed by system 10. At the bottom of air supply tank 40, outlet 49 preferably communicates through pressure regulator 50 with 4-way "tee" 52. As shown in FIG. 1, tee 52 in turn supplies air to pressure gauge 54 and tees 56, 58.

Tee 56 supplies air to three air supply lines 64, each one of which extends to a switch (not shown) on a different flame spray gun, and then returns to a valve inlet port 76 on the valve 74 connected to an outlet port 62 of hopper 12. Whenever the switch at the flame spray gun is in the "on" position, air pressure is delivered back to valve 74 through lines 64 and valve inlet port 76. Valves 74 are preferably adapted to open when air pressure is exerted through inlet ports 76, thereby permitting the outward flow of pressurized air and entrained plastic powder from hopper 12 to the associated flame spray gun through lines 82.

Tee 58 preferably supplies pressurized air through purge lines 66 and inlet ports 72 to continuously purge valves 74 and lines 82. Valves 74 are preferably designed so that purge air can be injected through valves 74 and lines 82 to purge remaining powder from valves 74 and lines 82 after valves 74 have been closed by operation of the switch on the respective flame spray gun to interrupt the flow of control air through lines 64.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A feed system for flame spray guns, comprising:

a. a pressurized hopper with a powder storage chamber, a pressure relief port, a plenum, a gas distributor board disposed between the powder storage chamber and the plenum, a powder support plate disposed above the gas distributor board and substantially parallel thereto, a pressurized air inlet port disposed below the gas distributor board, and at least one outlet port disposed above the gas distributor board but below the powder support plate;

b. pressurized air storage means attached to the pressurized hopper, and means for delivering a flow of pressurized air from the pressurized air storage means into the pressurized air inlet port of the plenum and upwardly through the gas distributor board to fluidize powder within the powder storage chamber and to entrain the powder in the pressurized air;

c. the outlet port communicating with a flow line for delivering the pressurized air and entrained powder to the flame spray gun and valve means disposed in the flow line having open and closed positions for controlling the flow of pressurized air and entrained powder to the flame spray gun;

d. means for delivering a pressurized glow of control air from the pressurized air storage means to the flame spray gun and to the valve means; and e. means for delivering pressurized air from the pressurized air storage means to the flow line to purge the flow line and valve means of powder after the valve means is closed.

* * * * *

UNITED STATES PATENT AND TRADEMARK OFFICE

CERTIFICATE OF CORRECTION

PATENT NO. : 5,269,463

DATED : DECEMBER 14, 1993

INVENTOR(S) : LEONARD R. BURKS

It is certified that error appears in the above-identified patent and that said Letters Patent is hereby corrected as shown below:

COLUMN 4, LINE 59, DELETE THE WORD "glow" AND INSERT THE WORD --flow--.

Signed and Sealed this

Twenty-third Day of August, 1994

*Attest:*

*Attesting Officer*

BRUCE LEHMAN

*Commissioner of Patents and Trademarks*